US007658506B2

(12) United States Patent
Dowling

(10) Patent No.: US 7,658,506 B2
(45) Date of Patent: Feb. 9, 2010

(54) RECESSED COVE LIGHTING APPARATUS FOR ARCHITECTURAL SURFACES

(75) Inventor: Kevin J. Dowling, Westford, MA (US)

(73) Assignee: Philips Solid-State Lighting Solutions, Inc., Burlington, MA (US)

( * ) Notice: Subject to any disclaimer, the term of this patent is extended or adjusted under 35 U.S.C. 154(b) by 263 days.

(21) Appl. No.: 11/748,100

(22) Filed: May 14, 2007

(65) Prior Publication Data

US 2007/0263379 A1 Nov. 15, 2007

Related U.S. Application Data

(60) Provisional application No. 60/747,110, filed on May 12, 2006.

(51) Int. Cl.
*F21S 8/00* (2006.01)

(52) U.S. Cl. ..... 362/147; 362/148; 362/231

(58) Field of Classification Search ..... 362/147, 362/153, 231, 84

See application file for complete search history.

(56) References Cited

U.S. PATENT DOCUMENTS 6,016,038 A * 1/2000 Mueller et al. ..... 315/291
6,150,774 A 11/2000 Mueller et al.
6,166,496 A 12/2000 Lys et al.
6,211,626 B1 4/2001 Lys et al.
6,292,901 B1 9/2001 Lys et al.
6,340,868 B1 1/2002 Lys et al.
D457,667 S 5/2002 Piepgras et al.
D457,669 S 5/2002 Piepgras et al.
D457,974 S 5/2002 Piepgras et al.
D458,395 S 6/2002 Piepgras et al.
D463,610 S 9/2002 Piepgras et al.
6,459,919 B1 10/2002 Lys et al.
D468,035 S 12/2002 Piepgras et al.
6,528,954 B1 3/2003 Lys et al.
6,548,967 B1 4/2003 Dowling et al.
6,577,080 B2 6/2003 Lys et al.
6,608,453 B2 8/2003 Morgan et al.
6,624,597 B2 9/2003 Dowling et al.
6,636,003 B2 10/2003 Rahm et al.
6,717,376 B2 4/2004 Lys et al.
6,720,745 B2 4/2004 Mueller et al.
D491,678 S 6/2004 Piepgras et al.
D492,042 S 6/2004 Piepgras et al.
6,774,584 B2 8/2004 Lys et al.
6,777,891 B2 8/2004 Lys et al.
6,781,329 B2 8/2004 Morgan et al.
6,788,011 B2 9/2004 Mueller et al.
6,801,003 B2 10/2004 Schanberger et al.
6,806,659 B1 10/2004 Mueller et al.
6,869,204 B2 3/2005 Piepgras et al.
6,883,929 B2 4/2005 Dowling
6,888,322 B2 5/2005 Dowling et al.
6,897,624 B2 5/2005 Ducharme et al.
6,936,978 B2 8/2005 Morgan et al.
6,965,205 B2 11/2005 Piepgras et al.
6,967,448 B2 11/2005 Morgan et al.
6,969,954 B2 11/2005 Lys
6,975,079 B2 12/2005 Lys et al.
D518,218 S 3/2006 Roberge et al.
7,014,336 B1 3/2006 Ducharme et al.

(Continued)

*Primary Examiner*—Ali Alavi

(57) ABSTRACT

Disclosed herein are cove lighting apparatus for architectural surfaces, particularly, recessed cove lighting apparatus integrated with an architectural surface and employing LED-based light sources.

15 Claims, 6 Drawing Sheets

U.S. PATENT DOCUMENTS

| | | | |
|---|---|---|---|
| 7,031,920 | B2 | 4/2006 | Dowling et al. |
| 7,038,398 | B1 | 5/2006 | Lys et al. |
| 7,038,399 | B2 | 5/2006 | Lys et al. |
| 7,042,172 | B2 | 5/2006 | Dowling et al. |
| 7,064,498 | B2 | 6/2006 | Dowling et al. |
| 7,113,541 | B1 | 9/2006 | Lys et al. |
| 7,132,785 | B2 | 11/2006 | Ducharme |
| 7,132,804 | B2 | 11/2006 | Mueller et al. |
| 7,135,824 | B2 | 11/2006 | Lys et al. |
| 7,139,617 | B1 | 11/2006 | Mueller et al. |
| 7,161,311 | B2 | 1/2007 | Mueller et al. |
| 7,161,313 | B2 | 1/2007 | Piepgras et al. |
| 7,161,556 | B2 | 1/2007 | Mueller et al. |
| 7,178,941 | B2 | 2/2007 | Roberge et al. |
| 7,180,252 | B2 | 2/2007 | Mueller et al. |
| 7,186,003 | B2 | 3/2007 | Dowling et al. |
| 7,187,141 | B2 | 3/2007 | Mueller et al. |
| 7,202,613 | B2 | 4/2007 | Morgan et al. |
| 7,204,622 | B2 | 4/2007 | Dowling et al. |
| 7,220,015 | B2 | 5/2007 | Dowling |
| 7,221,104 | B2 | 5/2007 | Lys et al. |
| 7,228,190 | B2 | 6/2007 | Dowling et al. |
| 7,231,060 | B2 | 6/2007 | Dowling et al. |
| 7,233,115 | B2 | 6/2007 | Lys |
| 7,233,831 | B2 | 6/2007 | Blackwell |
| 7,242,152 | B2 | 7/2007 | Dowling et al. |
| 7,248,239 | B2 | 7/2007 | Dowling et al. |
| D548,868 | S | 8/2007 | Roberge et al. |
| 7,253,566 | B2 | 8/2007 | Lys et al. |
| 7,255,457 | B2 | 8/2007 | Ducharme et al. |
| 7,256,554 | B2 | 8/2007 | Lys |
| 7,274,160 | B2 | 9/2007 | Mueller et al. |
| 7,300,192 | B2 | 11/2007 | Mueller et al. |
| 7,303,300 | B2 | 12/2007 | Dowling et al. |
| 7,308,296 | B2 | 12/2007 | Lys et al. |
| 7,309,965 | B2 | 12/2007 | Dowling et al. |
| D562,494 | S | 2/2008 | Piepgras |
| 2002/0074559 | A1 | 6/2002 | Dowling et al. |
| 2002/0078221 | A1 | 6/2002 | Blackwell et al. |
| 2002/0130627 | A1 | 9/2002 | Dowling et al. |
| 2002/0152045 | A1 | 10/2002 | Dowling et al. |
| 2002/0176259 | A1 | 11/2002 | Ducharme |
| 2003/0057884 | A1 | 3/2003 | Dowling et al. |
| 2003/0076281 | A1 | 4/2003 | Morgan et al. |
| 2003/0133292 | A1 | 7/2003 | Mueller et al. |
| 2004/0052076 | A1 | 3/2004 | Mueller et al. |
| 2004/0105261 | A1 | 6/2004 | Ducharme et al. |
| 2004/0116039 | A1 | 6/2004 | Mueller et al. |
| 2004/0141321 | A1 | 7/2004 | Dowling et al. |
| 2004/0212993 | A1 | 10/2004 | Morgan et al. |
| 2005/0035728 | A1 | 2/2005 | Dowling et al. |
| 2005/0041161 | A1 | 2/2005 | Dowling et al. |
| 2005/0047134 | A1 | 3/2005 | Mueller et al. |
| 2005/0063194 | A1 | 3/2005 | Mueller et al. |
| 2005/0099824 | A1 | 5/2005 | Dowling et al. |
| 2005/0116667 | A1 | 6/2005 | Mueller et al. |
| 2005/0151489 | A1 | 7/2005 | Lys et al. |
| 2005/0174473 | A1 | 8/2005 | Dowling et al. |
| 2005/0213352 | A1 | 9/2005 | Lys et al. |
| 2005/0213353 | A1 | 9/2005 | Lys |
| 2005/0218870 | A1 | 10/2005 | Lys |
| 2005/0219872 | A1 | 10/2005 | Lys |
| 2005/0236998 | A1 | 10/2005 | Mueller |
| 2005/0248299 | A1 | 11/2005 | Chemel et al. |
| 2005/0253533 | A1 | 11/2005 | Lys et al. |
| 2005/0275626 | A1 | 12/2005 | Mueller |
| 2005/0276053 | A1 | 12/2005 | Nortrup |
| 2006/0002110 | A1 | 1/2006 | Dowling |
| 2006/0012987 | A9 | 1/2006 | Ducharme |
| 2006/0016960 | A1 | 1/2006 | Morgan |
| 2006/0022214 | A1 | 2/2006 | Morgan |
| 2006/0076908 | A1 | 4/2006 | Morgan |
| 2006/0098077 | A1 | 5/2006 | Dowling |
| 2006/0104058 | A1 | 5/2006 | Chemel et al. |
| 2006/0109649 | A1 | 5/2006 | Ducharme et al. |
| 2006/0132061 | A1 | 6/2006 | McCormick et al. |
| 2006/0152172 | A9 | 7/2006 | Mueller |
| 2006/0158881 | A1 | 7/2006 | Dowling |
| 2006/0170376 | A1 | 8/2006 | Dowling et al. |
| 2006/0198128 | A1 | 9/2006 | Piepgras et al. |
| 2006/0208667 | A1 | 9/2006 | Lys |
| 2006/0221606 | A1 | 10/2006 | Dowling |
| 2006/0262521 | A1 | 11/2006 | Piepgras |
| 2006/0262544 | A1 | 11/2006 | Piepgras |
| 2006/0262545 | A1 | 11/2006 | Piepgras |
| 2006/0273741 | A1 | 12/2006 | Stalker, III |
| 2006/0285325 | A1 | 12/2006 | Ducharme et al. |
| 2007/0086754 | A1 | 4/2007 | Lys et al. |
| 2007/0086912 | A1 | 4/2007 | Dowling |
| 2007/0115658 | A1 | 5/2007 | Mueller et al. |
| 2007/0115665 | A1 | 5/2007 | Mueller et al. |
| 2007/0145915 | A1 | 6/2007 | Roberge et al. |
| 2007/0152797 | A1 | 7/2007 | Chemel et al. |
| 2007/0153514 | A1 | 7/2007 | Dowling |
| 2007/0171631 | A1* | 7/2007 | Davis ..... 362/147 |
| 2007/0188114 | A1 | 8/2007 | Lys et al. |
| 2007/0188427 | A1 | 8/2007 | Lys et al. |
| 2007/0189026 | A1 | 8/2007 | Chemel et al. |
| 2007/0195526 | A1 | 8/2007 | Mueller et al. |
| 2007/0206375 | A1 | 9/2007 | Piegras et al. |
| 2007/0236156 | A1 | 10/2007 | Lys et al. |
| 2007/0237284 | A1 | 10/2007 | Lys et al. |
| 2007/0258231 | A1 | 11/2007 | Koerner et al. |
| 2007/0258240 | A1 | 11/2007 | Ducharme et al. |
| 2007/0263379 | A1 | 11/2007 | Dowling et al. |
| 2007/0291483 | A1 | 12/2007 | Lys et al. |
| 2008/0012502 | A1 | 1/2008 | Lys |
| 2008/0012506 | A1 | 1/2008 | Mueller et al. |

* cited by examiner

RECESSED COVE LIGHTING APPARATUS FOR ARCHITECTURAL SURFACES

CROSS-REFERENCE TO RELATED APPLICATION

This application claims priority under 35 U.S.C. §119(e) to U.S. Provisional Application Ser. No. 60/747,110 filed on May 12, 2006, incorporated herein by reference.

TECHNICAL FIELD

The present invention is generally directed to cove lighting apparatus for architectural surfaces and, more particularly, to recessed cove lighting apparatus employing LED-based light sources and methods of their manufacture and installation.

BACKGROUND

Drywall is a commonly-used construction material that provides an inexpensive yet robust option for the construction of internal architectural surfaces. Large sheets of drywall can be cut and shaped to fit a wide variety of shapes to form internal walls and ceiling of a dwelling. Gaps can be created by removing a portion from the drywall sheets so that features such as doors, windows, electrical outlets or other desired wall elements can be included in a wall. These gaps may be created before or after they are put into their desired position. Shaped and cut drywall sheets are generally installed in an internal space by first securing the sheets to a wooden or steel frame. The individual wooden or steel beams that make up the wooden frame are commonly referred to as studs. Once the drywall sheets are secured to the studs, a subsequent installation step includes applying a drywall compound to the seams and corners of the drywall sheets and to any screws and other fasteners used to secure the drywall sheets to the studs. The drywall compound hides any dents or seams in a drywall sheet so as to provide an essentially flat surface. Typically, a corner bead made from metal or plastic is applied to outside corners before the drywall compound is applied, so as to reinforce the corners and ensure straight corner edges.

Recessed lighting is a popular illumination option for both new dwellings and remodeling or renovation of existing dwellings. With recessed lighting, the majority of a lighting fixture is disposed substantially behind or recessed into an architectural surface or feature, such as a ceiling, wall, or soffit. The lighting fixture typically includes a housing, a light source, such as an incandescent, fluorescent or halogen bulb, and some means for electrically connecting the fixture to a source of operating power. With new construction, the fixture is typically supported by hangars attached to joists. When remodeling, the fixture may be inserted through an aperture in an existing surface and attached to the surface material, such that the aperture provides a path for light generated by the light source.

Light is commonly used as an accent in both internal and external spaces. Different lighting effects applied to the same space can create significantly different feels and moods within the space. Many conventional lighting systems, however, are subject to a number of drawbacks, limiting their applicability for accent lighting.

For example, conventional light sources, such as halogen and incandescent bulbs, produce undesirable heat and typically have very limited life spans. Also, these light sources frequently require complex lens and filtering systems in order to produce color and often may not adequately reproduce precise color conditions and effects. Further, as mentioned above, in recessed applications, lighting fixtures employing these sources require bulky housings or frames and are often difficult to install.

Accordingly, a need exists for lighting systems that address the drawbacks of conventional approaches for recessed cove lighting applications.

SUMMARY OF THE INVENTION

Advances in digital lighting technologies, i.e. illumination based on semiconductor light sources, such as light-emitting diodes (LEDs), have provided affordable, efficient, and robust lighting LED-based devices that presents opportunities to use light as an architectural accent in ways that were not previously available. These lighting devices have integral microprocessors for controlling LED light sources therein, as described in U.S. Pat. Nos. 6,016,038, 6,150,774 and 6,166,496, all incorporated herein by reference, and can produce any color and any sequence of colors at varying intensities and saturations, enabling a wide range of eye-catching lighting effects.

In view of the foregoing, various embodiments of the present invention are directed to methods and apparatus for creating a light cove that is integrated with an architectural surface. In particular, Applicant has recognized and appreciated that light sources such as LEDs can be arranged within a wall as part of a cove, without the need for a special bezel or frame, so as to create intriguing "light surface effects." In various embodiments of the present invention, a formed cove is installed into a gap in a wall surface (e.g., an internal wall made from drywall). The formed cove may include at least one lighting unit that can be used to light the cove.

Generally, in one aspect, the invention focuses on a cove lighting apparatus for an architectural surface. The apparatus includes a cove member having an interior surface and configured to fit within a gap defined by the architectural surface. The apparatus also includes at least one light LED-based source associated with the cove member for irradiating at least a portion of the interior surface with visible light perceivable by a viewer from the architectural surface without observing the at least one light LED-based source. In particular, in one aspect, the cove lighting apparatus is configured such that the at least one LED-based light source is concealed from the viewer.

Another embodiment of the invention is directed to a method for providing architectural illumination. The method comprises: forming a gap in an architectural surface; disposing a cove member in the gap defined by the architectural surface, the cove member comprising an interior surface that is recessed from the architectural surface; generating visible light by at least one light LED-based source; and irradiating at least a portion of the interior surface with visible light such that the visible light is perceivable by a viewer via the gap as a light surface that is essentially flush with the architectural surface.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term "LED" does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The terms "lighting unit" and "lighting fixture" are used interchangeably herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DESCRIPTION

Various embodiments of the present invention are described below, including certain embodiments relating particularly to LED-based light sources. It should be appreciated, however, that the present invention is not limited to any particular manner of implementation, and that the various embodiments discussed explicitly herein are primarily for purposes of illustration. For example, the various concepts discussed herein may be suitably implemented in a variety of environments involving LED-based light sources, other types of light sources not including LEDs, environments that involve both LEDs and other types of light sources in combination, and environments that involve non-lighting-related devices alone or in combination with various types of light sources.

Figure 1:
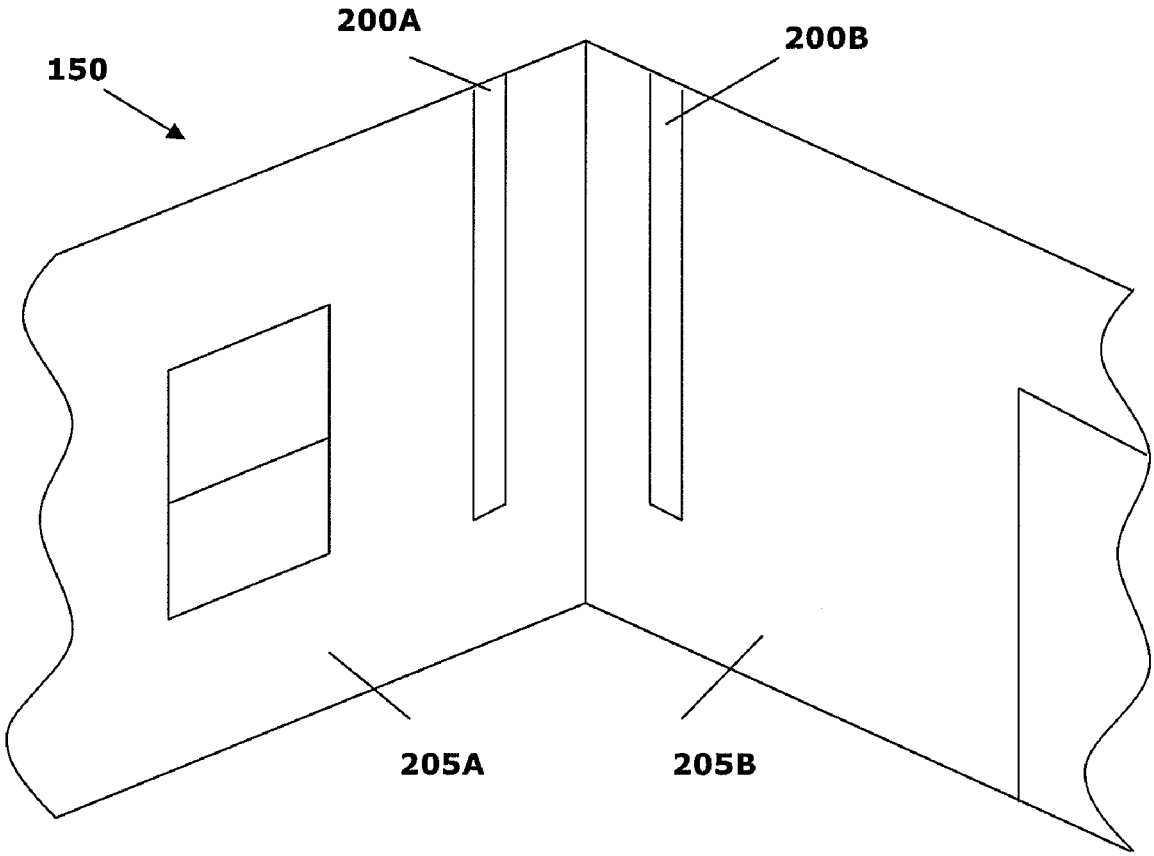
FIG. 1 is an illustration of a room having a cove lighting apparatus installed in two of its walls according to various embodiments of the invention.

The present invention is directed generally to lighting apparatus configured to form a "light cove." As discussed in more detail below, in various embodiments of the invention, one or more light sources are installed in a cut-out area or gap in an architectural surface, without requiring a bezel or a frame, such that, in operation, no features other than generated light are evident in the gap. The resulting visible effect appears as an essentially uniform and featureless "floating light," wherein the void of the gap in the architectural surface is filled with light. In particular embodiments, no front plate, diffuser, translucent material or the like is used to cover the gap. Referring to FIG. 1, in one exemplary application, cove lighting apparatus 200A, 200B is installed in walls 205A, 205B of a room 150.

Figure 2A:
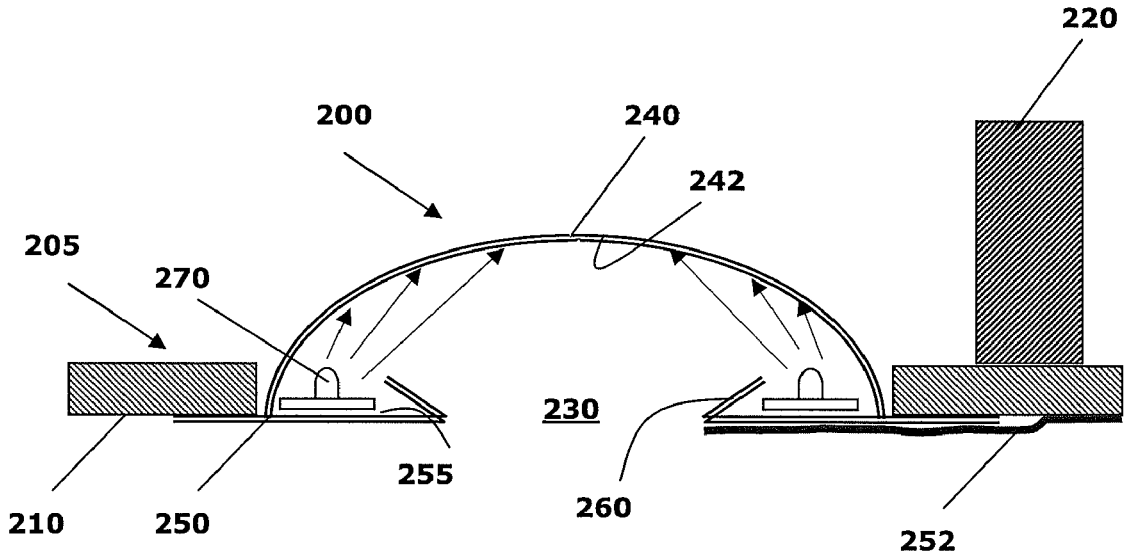
FIG. 2A-2B are schematic cross-sectional views of the apparatus of FIG. 1.

Referring to FIG. 2A, in many embodiments of the present invention, a cove lighting apparatus 200 is arranged to extend into a part of an architectural surface, e.g. a wall structure 205 (i.e., recessed in the wall). The wall structure may be constructed from any material, and may include a gap 230 in which the cove lighting apparatus is arranged so that at least a portion of an interior of the apparatus 200 can be viewed by an observer. The outline of the gap in the wall may have virtually any shape including, but not limited to, a rectangle, polygon, curve, oval, circle, etc. In one particular embodiment, the wall structure is constructed from one or more drywall sheets arranged on a conventional stud-based construction frame 220, and the gap is created by removing a portion from the one or more drywall sheets.

Still referring to FIG. 2A, in various embodiments, the cove lighting apparatus includes a cove member 240 having an interior surface 242 ("cove surface") at least partially visible to the observer in the designated viewing area provided by the gap 230. The cove member may be constructed from any material, including, without limitation, plastic, sheet metal, or any other formed (e.g., extruded) material. In some embodiments, at least part of the interior cove surface 242 is a matte white surface configured to reflect and diffuse light. In addition, the cove member may comprise a single piece of material or one or more parts coupled together, and have a variety of shapes in cross-section including, but not limited to, a rectangle, polygon, curve, oval, and circle. In other embodiments, the shape of the cove member may be similar to a shape of the gap itself, and may extend in one or more directions beyond a contour of the gap so that a portion of the interior cove surface 242 is hidden, as discussed further below.

In various embodiments, the cove member 240 is coupled to a wall 205, for example, and configured to fit into the gap 230 and be secured therein without the need for any additional fastening devices. The cove member may be flat, concave, or convex, and may be shaped as a semi-sphere having a first portion set back from the wall and an edge portion flush with a wall surface 210. In certain embodiments of the present invention mentioned above where the gap 230 is formed by removing a portion of one or more drywall sheets arranged on a standard stud-based construction frame 220, the cove member may extend into a space behind the wall up to 1"-4" from the wall surface, for example, to a depth of about 3.5".

In some embodiments of the present invention, the cove lighting apparatus 200 may also include at least one supporting member, for example, a flange 250, configured to support the apparatus in the gap and extending at least partially along the wall surface 210. The flange may be fastened to the wall via one or more of an adhesive, a clip, nail, screw, or other fastening device and then covered with a drywall compound 252 so as to conceal any fasteners used to fasten the flange to the wall. In various embodiments, the cove member 240 may be coupled perpendicularly to the flange, the cove member and flange may be made from one formed piece of material, or the cove member and flange may be separate pieces.

With continued reference to FIG. 2A, in various embodiments, the cove lighting apparatus includes a channel portion 255 having an interior channel surface generally facing the interior cove surface 242. In many embodiments, the cove member 240 is coupled generally perpendicularly to the channel portion 255. In some versions of these embodiments, both the interior cove surface and the interior channel surface are surfaces of the cove member, i.e. the cove member includes the channel portion generally parallel to the flange 250. In another version, the channel portion is formed by a portion of the flange, and the interior channel surface constitutes an interior surface of the flange 250. Generally, the channel portion 255 may be arranged so that the wall appears to extend into a portion of the gap 230. In particular, the channel portion may be finished like drywall (covered with drywall compound 252 and painted) to appear smooth and continuous with the wall. Thus, the channel portion may hide some of the cove surface from the observer in the designated viewing area formed by the gap 230. In yet another aspect, the channel portion may be arranged such that the observer is unable to see the cove surface coupling to the channel surface, or the cove member coupling to the flange or the wall.

In some embodiments of the invention, the cove lighting apparatus includes at least one blocking member 260 coupled to the channel portion 255 at an acute angle thereto. The channel portion and blocking member may form a beaded end for the application of drywall compound. In various versions of these embodiments, one or more lighting units described in more detail below are disposed over the interior channel surface of the channel portion proximate to the blocking member such that the lighting unit(s) are concealed from the observer in the designated viewing area by the blocking member and the channel portion 255.

Figure 2B:
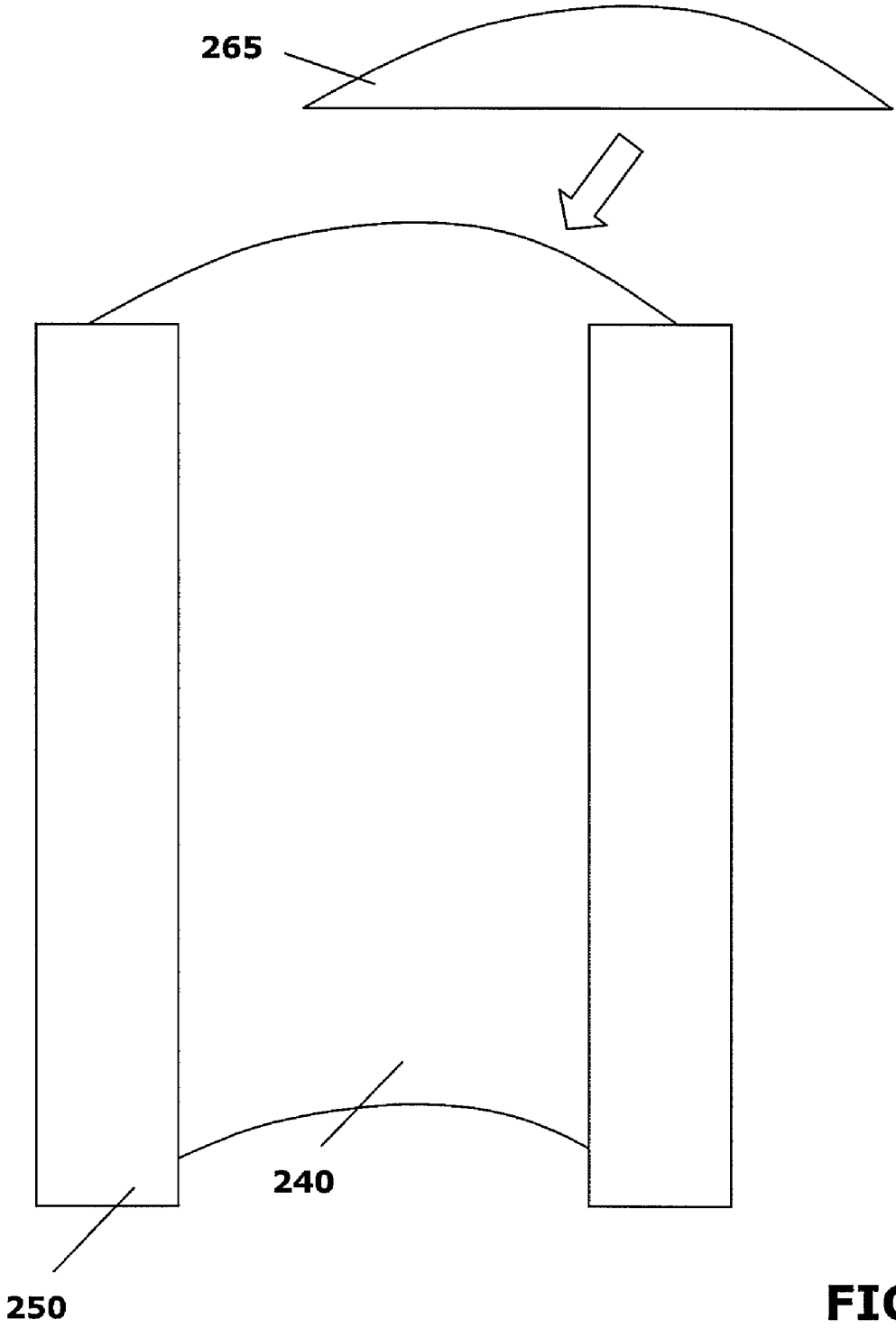

In various embodiments, an observer's line of sight is taken into account in the particular placement of a gap in an architectural surface outfitted with the cove lighting apparatus of the present invention. For example, while a top portion of the apparatus may not be visible to an observer, as it may be above or flush with an upper contour of the gap in the surface, a bottom portion of the cove may be visible. Accordingly, referring to FIG. 2B, in one embodiment, the apparatus includes an end cap 265 that provides a finished surface similar to the cove surface at the bottom of the apparatus. If a flange 250 is employed to facilitate positioning and fixing of the light cove apparatus to the architectural surface, the flange may be trimmed near the bottom end and tilted into place to form the bottom portion. In another implementation, an end cap may be a pre-formed friction-fit unit having a shape that follows the contour of the cove surface, so that it may be easily installed through the gap once the cove surface is in place within the gap.

Figure 3:
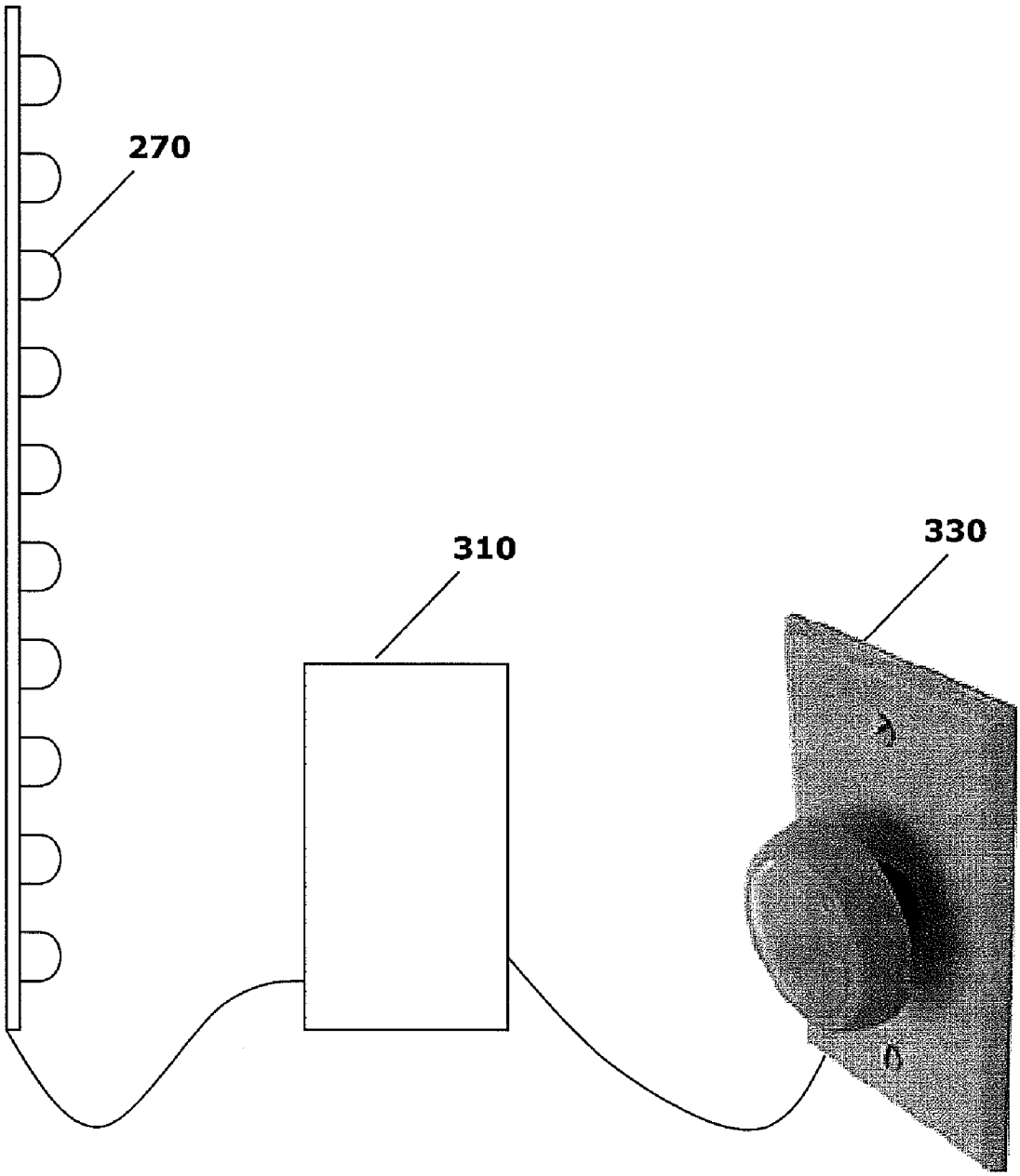
FIG. 3 is a diagram illustrating a user interface connected to a power supply and the lighting unit of the cove lighting apparatus, according to some embodiments of the invention.

Referring to FIG. 3, as well as with continued reference to FIG. 2A, the cove lighting apparatus further includes one or more lighting units 270 arranged such that light generated by the lighting unit(s) illuminates at least a part of the interior portion of the cove surface. The lighting units can be powered by an external power supply 310 and controlled via a user interface 330, for example, of a type described in U.S. Patent Application Publication No. 20030028260, incorporated herein by reference. In some embodiments, the light emanating from the cove lighting apparatus is perceived by the observer as a light surface generally flush with the wall surface 210. In various embodiments, the lighting unit(s) may be LED-based lighting units, as discussed in greater detail below in connection with FIGS. 4 and 5, and include one or more LEDs arranged on one or more LED boards. The apparatus may be generally configured such that the LED boards can easily be installed and secured over the interior surface of the channel portion 255. For example, the LED boards may be arranged such that each LED board can slide into or snap into place. The LED boards and the channel portion may be arranged such that the boards can be installed in and removed from a previously installed cove apparatus 200 through the gap 230 without removing any other portion of the apparatus. A variety of LED package types may be employed in the LED-based lighting unit(s), such as 5 millimeter style LEDs, chip on board, power packages, and SMT (surface mount technology) packages.

Figure 4:
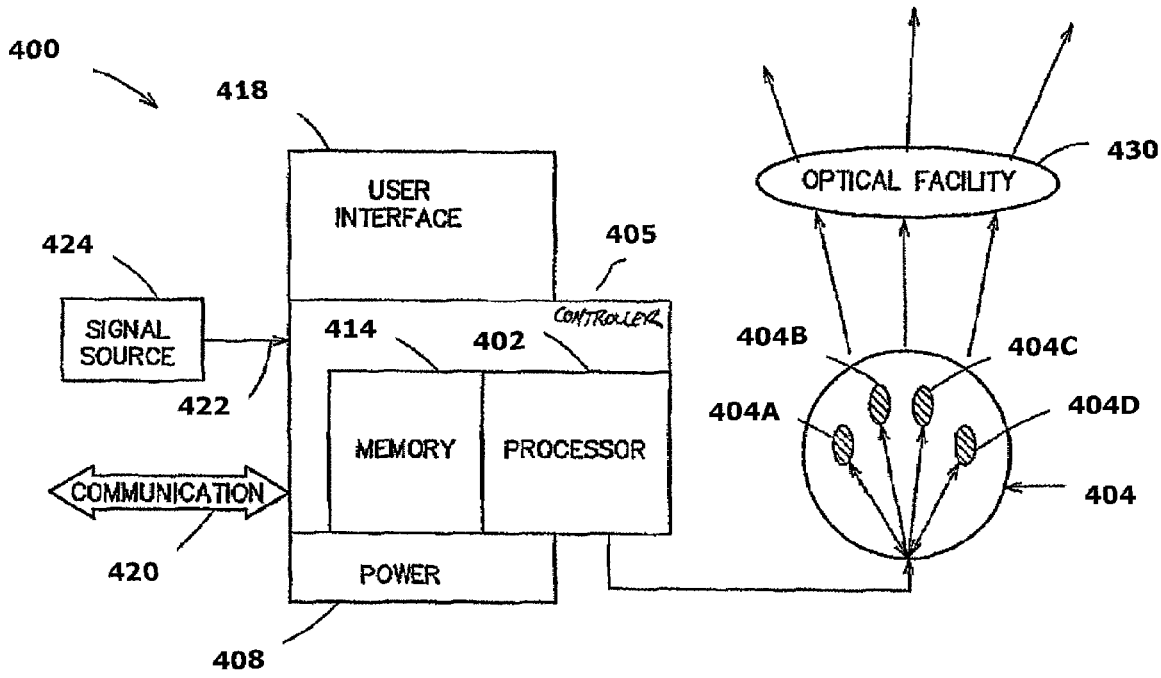
FIG. 4 is a diagram illustrating a lighting unit suitable for the cove lighting apparatus according to various embodiment of the invention.

FIG. 4 illustrates one example of an LED-based lighting unit 400 that may be employed in the cove lighting apparatus 200 of the present invention to implement various aspects of light generation and control as discussed above in connection with FIG. 3 (e.g., various constituent components of the lighting unit 400 discussed in greater below in connection with FIG. 4 may be employed to implement the lighting unit(s) 270, power supply 310 and user interface 330 shown in FIG. 3). Some general examples of LED-based lighting units similar to those that are described below in connection with FIG. 4 may be found, for example, in U.S. Pat. No. 6,016,038, issued Jan. 18, 2000 to Mueller et al., entitled "Multicolored LED Lighting Method and Apparatus," and U.S. Pat. No. 6,211,626, issued Apr. 3, 2001 to Lys et al, entitled "Illumination Components," both hereby incorporated herein by reference.

In various embodiments of the present invention, the lighting unit 400 may be used alone or together with other similar lighting units in a system of lighting units (e.g., as discussed further below in connection with FIG. 5). Used alone or in combination with other lighting units, the lighting unit 400 may be employed in one or more cove lighting apparatus to provide a variety of lighting and other functions in a given environment including, but not limited to, interior or exterior space (e.g., architectural) lighting and illumination in general, direct or indirect illumination of objects or spaces, entertainment-based/special effects lighting, decorative lighting, safety-oriented lighting, combined lighting or illumination and communication, as well as various indication, display and informational functions.

In some embodiments, the lighting unit 400 shown in FIG. 4 may include one or more light sources 404A, 404B, 404C, and 404D (shown collectively as 404), wherein one or more of the light sources may be an LED-based light source that includes one or more light emitting diodes (LEDs). In some versions of these embodiments, any two or more of the light sources may be adapted to generate radiation of different colors (e.g. red, green, blue); in this respect, as discussed above, each of the different color light sources generates a different source spectrum that constitutes a different "channel" of a "multi-channel" lighting unit. Although FIG. 4 shows four light sources 404A, 404B, 404C, and 404D, it should be appreciated that the lighting unit is not limited in this respect, as different numbers and various types of light sources (all LED-based light sources, LED-based and non-LED-based light sources in combination, etc.) adapted to generate radiation of a variety of different colors, including essentially white light, may be employed in the lighting unit 400, as discussed further below.

Referring to FIG. 4, the lighting unit 400 also may include a controller 405 that is configured to output one or more control signals to drive the light sources so as to generate various intensities of light from the light sources. For example, in one embodiment, the controller may be configured to output at least one control signal for each light source so as to independently control the intensity or overall amount of light (e.g., radiant power in lumens) generated by each light source; alternatively, the controller may be configured to output one or more control signals to collectively control a group of two or more light sources identically. Some examples of control signals that may be generated by the controller to control the light sources include, but are not limited to, pulse modulated signals, pulse width modulated signals (PWM), pulse amplitude modulated signals (PAM), pulse code modulated signals (PCM), analog control signals (e.g., current control signals, voltage control signals), combinations and/or modulations of the foregoing signals, or other control signals. In one aspect, particularly in connection with LED-based sources, one or more modulation techniques provide for variable control using a fixed current level applied to one or more LEDs, so as to mitigate potential undesirable or unpredictable variations in LED output that may arise if a variable LED drive current were employed. In another aspect, the controller may control other dedicated circuitry (not shown) which in turn controls the light sources so as to vary their respective intensities.

In general, the intensity (radiant output power) of radiation generated by the one or more light sources is proportional to the average power delivered to the light source(s) over a given time period. Accordingly, one technique for varying the intensity of radiation generated by the one or more light sources involves modulating the power delivered to (i.e., the operating power of) the light source(s). For some types of light sources, including LED-based sources, this may be accomplished effectively using a pulse width modulation (PWM) technique.

In one exemplary implementation of a PWM control technique, for each channel of a lighting unit a fixed predetermined voltage $V_{source}$ is applied periodically across a given light source constituting the channel. The application of the voltage $V_{source}$ may be accomplished via one or more switches (not shown) controlled by the controller 405. While the voltage $V_{source}$ is applied across the light source, a predetermined fixed current $I_{source}$ (e.g., determined by a current regulator) is allowed to flow through the light source. Again, recall that an LED-based light source may include one or more LEDs, such that the voltage $V_{source}$ may be applied to a group of LEDs constituting the source, and the current $I_{source}$ may be drawn by the group of LEDs. The fixed voltage $V_{source}$ across the light source when energized, and the regulated current $I_{source}$ drawn by the light source when energized, determines the amount of instantaneous operating power $P_{source}$ of the light source ($P_{source}=V_{source}\cdot I_{source}$). As mentioned above, for LED-based light sources, using a regulated current mitigates potential undesirable or unpredictable variations in LED output that may arise if a variable LED drive current were employed.

According to the PWM technique, by periodically applying the voltage $V_{source}$ to the light source and varying the time the voltage is applied during a given on-off cycle, the average power delivered to the light source over time (the average operating power) may be modulated. In particular, the controller 405 may be configured to apply the voltage $V_{source}$ to a given light source in a pulsed fashion (e.g., by outputting a control signal that operates one or more switches to apply the voltage to the light source), preferably at a frequency that is greater than that capable of being detected by the human eye (e.g., greater than approximately 100 Hz). In this manner, an observer of the light generated by the light source does not perceive the discrete on-off cycles (commonly referred to as a "flicker effect"), but instead the integrating function of the eye perceives essentially continuous light generation. By adjusting the pulse width (i.e. on-time, or "duty cycle") of on-off cycles of the control signal, the controller varies the average amount of time the light source is energized in any given time period, and hence varies the average operating power of the light source. In this manner, the perceived brightness of the generated light from each channel in turn may be varied.

As discussed in greater detail below, the controller 405 may be configured to control each different light source channel of a multi-channel lighting unit at a predetermined average operating power to provide a corresponding radiant output power for the light generated by each channel. Alternatively, the controller may receive instructions (e.g., "lighting commands") from a variety of origins, such as a user interface 418, a signal source 424, or one or more communication ports 420, that specify prescribed operating powers for one or more channels and, hence, corresponding radiant output powers for the light generated by the respective channels. By varying the prescribed operating powers for one or more channels (e.g., pursuant to different instructions or lighting commands), different perceived colors and brightness levels of light may be generated by the lighting unit.

In one embodiment of the lighting unit 400, as mentioned above, one or more of the light sources 404 may include a group of multiple LEDs or other types of light sources (e.g., various parallel and/or serial connections of LEDs or other types of light sources) that are controlled together by the controller. Additionally, it should be appreciated that one or more of the light sources may include one or more LEDs that are adapted to generate radiation having any of a variety of spectra (i.e., wavelengths or wavelength bands), including, but not limited to, various visible colors (including essentially white light), various color temperatures of white light, ultraviolet, or infrared. LEDs having a variety of spectral bandwidths (e.g., narrow band, broader band) may be employed in various implementations of the lighting unit 400.

In another aspect of the lighting unit 100 shown in FIG. 4, the lighting unit may be constructed and arranged to produce a wide range of variable color radiation. For example, in one embodiment, the lighting unit may be particularly arranged such that controllable variable intensity (i.e., variable radiant power) light generated by two or more of the light sources combines to produce a mixed colored light (including essentially white light having a variety of color temperatures). In particular, the color (or color temperature) of the mixed colored light may be varied by varying one or more of the respective intensities (output radiant power) of the light sources (e.g., in response to one or more control signals output by the controller). Furthermore, the controller 405 may be particularly configured to provide control signals to one or more of the light sources so as to generate a variety of static or time-varying (dynamic) multi-color (or multi-color temperature) lighting effects. To this end, in one embodiment, the controller may include a processor 402 (e.g., a microprocessor) programmed to provide such control signals to one or more of the light sources. In various aspects, the processor may be programmed to provide such control signals autonomously, in response to lighting commands, or in response to various user or signal inputs.

Thus, the lighting unit 400 may include a wide variety of colors of LEDs in various combinations, including two or more of red, green, and blue LEDs to produce a color mix, as well as one or more other LEDs to create varying colors and color temperatures of white light. For example, red, green and blue can be mixed with amber, white, UV, orange, IR or other colors of LEDs. Such combinations of differently colored LEDs in the lighting unit 100 can facilitate accurate reproduction of a host of desirable spectrums of lighting conditions, examples of which include, but are not limited to, a variety of outside daylight equivalents at different times of the day, various interior lighting conditions, lighting conditions to simulate a complex multicolored background, and the like. Other desirable lighting conditions can be created by removing particular pieces of spectrum that may be specifically absorbed, attenuated or reflected in certain environments.

As also shown in FIG. 4, the lighting unit 400 also may include a memory 414 to store various data. For example, the memory may be employed to store one or more lighting commands or programs for execution by the processor 402 (e.g., to generate one or more control signals for the light sources), as well as various types of data useful for generating variable color radiation (e.g., calibration information, discussed further below). The memory also may store one or more particular identifiers (e.g., a serial number, an address, etc.) that may be used either locally or on a system level to identify the lighting unit. In various embodiments, such identifiers may be pre-programmed by a manufacturer, for example, and may be either alterable or non-alterable thereafter (e.g., via some type of user interface located on the lighting unit, via one or more data or control signals received by the lighting unit, etc.). Alternatively, such identifiers may be determined at the time of initial use of the lighting unit in the field, and again may be alterable or non-alterable thereafter.

The lighting unit 400 optionally may include one or more user interfaces 418, for example, the user interface 330 shown in FIG. 3 and generally described in U.S. Patent Application Publication No. 20030028260, that are provided to facilitate any of a number of user-selectable settings or functions (e.g., generally controlling the light output of the lighting unit, changing and/or selecting various pre-programmed lighting effects to be generated by the lighting unit, changing and/or selecting various parameters of selected lighting effects, setting particular identifiers such as addresses or serial numbers for the lighting unit, etc.). In various embodiments, the communication between the user interface and the lighting unit may be accomplished through wire or cable, or wireless transmission.

In some embodiments, the controller 405 of the lighting unit monitors the user interface 418 and controls one or more of the light sources 404 based at least in part on a user's operation of the interface. For example, the controller may be configured to respond to operation of the user interface by originating one or more control signals for controlling one or more of the light sources. Alternatively, the processor 402 may be configured to respond by selecting one or more pre-programmed control signals stored in memory, modifying control signals generated by executing a lighting program, selecting and executing a new lighting program from memory, or otherwise affecting the radiation generated by one or more of the light sources.

In particular, in one implementation, the user interface 418 may constitute one or more switches (e.g., a standard wall switch) that interrupt power to the controller 405. In one aspect of this implementation, the controller is configured to monitor the power as controlled by the user interface, and in turn control one or more of the light sources based at least in part on duration of a power interruption caused by operation of the user interface. As discussed above, the controller may be particularly configured to respond to a predetermined duration of a power interruption by, for example, selecting one or more pre-programmed control signals stored in memory, modifying control signals generated by executing a lighting program, selecting and executing a new lighting program from memory, or otherwise affecting the radiation generated by one or more of the light sources.

FIG. 4 also illustrates that the lighting unit 400 may be configured to receive one or more signals 422 from one or more other signal sources 424. In one implementation, the controller 405 of the lighting unit may use the signal(s) 422, either alone or in combination with other control signals (e.g., signals generated by executing a lighting program, one or more outputs from a user interface, etc.), so as to control one or more of the light sources 404 in a manner similar to that discussed above in connection with the user interface.

Examples of the signal(s) 422 that may be received and processed by the controller include, but are not limited to, one or more audio signals, video signals, power signals, various types of data signals, signals representing information obtained from a network (e.g., the Internet), signals representing one or more detectable/sensed conditions, signals from lighting units, signals consisting of modulated light, etc. In various implementations, the signal source(s) 424 may be located remotely from the lighting unit, or included as a component of the lighting unit. In one embodiment, a signal from one lighting unit could be sent over a network to another lighting unit.

Some examples of a signal source 424 that may be employed in, or used in connection with, the lighting unit 400 include any of a variety of sensors or transducers that generate one or more signals 422 in response to some stimulus. Examples of such sensors include, but are not limited to, various types of environmental condition sensors, such as thermally sensitive (e.g., temperature, infrared) sensors, humidity sensors, motion sensors, photosensors/light sensors (e.g., photodiodes, sensors that are sensitive to one or more particular spectra of electromagnetic radiation such as spectroradiometers or spectrophotometers, etc.), various types of cameras, sound or vibration sensors or other pressure/force transducers (e.g., microphones, piezoelectric devices), and the like.

Additional examples of a signal source 424 include various metering/detection devices that monitor electrical signals or characteristics (e.g., voltage, current, power, resistance, capacitance, inductance, etc.) or chemical/biological characteristics (e.g., acidity, a presence of one or more particular chemical or biological agents, bacteria, etc.) and provide one or more signals 422 based on measured values of the signals or characteristics. Yet other examples of a signal source include various types of scanners, image recognition systems, voice or other sound recognition systems, artificial intelligence and robotics systems, and the like. A signal source could also be a lighting unit, another controller or processor, or any one of many available signal generating devices, such as media players, MP3 players, computers, DVD players, CD players, television signal sources, camera signal sources, microphones, speakers, telephones, cellular phones, instant messenger devices, SMS devices, wireless devices, personal organizer devices, and many others.

The lighting unit 400 may also include one or more optical elements 430 to optically process the radiation generated by the light sources 404. For example, one or more optical elements may be configured so as to change one or both of a spatial distribution and a propagation direction of the generated radiation. In particular, one or more optical elements may be configured to change a diffusion angle of the generated radiation. In one aspect of this embodiment, one or more optical elements may be particularly configured to variably change one or both of a spatial distribution and a propagation direction of the generated radiation (e.g., in response to some electrical and/or mechanical stimulus). Examples of optical elements that may be included in the lighting unit include, but are not limited to, reflective materials, refractive materials, translucent materials, filters, lenses, mirrors, and fiber optics. The optical element also may include a phosphorescent material, luminescent material, or other material capable of responding to or interacting with the generated radiation.

Further, still referring to FIG. 4, the lighting unit 400 may include one or more communication ports 420 to facilitate coupling of the lighting unit to any of a variety of other devices. For example, one or more communication ports may facilitate coupling multiple lighting units together as a networked lighting system, in which at least some of the lighting units are addressable (e.g., have particular identifiers or addresses) and are responsive to particular data transported across the network.

In particular, in a networked lighting system environment, as discussed in greater detail further below (e.g., in connection with FIG. 4), as data is communicated via the network, the controller 405 of each lighting unit coupled to the network may be configured to be responsive to particular data (e.g., lighting control commands) that pertain to it (e.g., in some cases, as dictated by the respective identifiers of the networked lighting units). Once a given controller identifies particular data intended for it, it may read the data and, for example, change the lighting conditions produced by its light sources according to the received data (e.g., by generating appropriate control signals to the light sources). In some embodiments, the memory 414 of each lighting unit coupled to the network may be loaded, for example, with a table of lighting control signals that correspond with data the processor 402 of the controller receives. Once the processor receives data from the network, the processor may consult the table to select the control signals that correspond to the received data, and control the light sources of the lighting unit accordingly.

In one version of these embodiments, the processor of a given lighting unit, whether or not coupled to a network, may be configured to interpret lighting instructions/data that are received in a DMX protocol (as discussed, for example, in U.S. Pat. Nos. 6,016,038 and 6,211,626), which is a lighting command protocol conventionally employed in the lighting industry for some programmable lighting applications. For example, in one aspect, considering for the moment a lighting unit based on red, green and blue LEDs (i.e., an "R-G-B" lighting unit), a lighting command in DMX protocol may specify each of a red channel command, a green channel command, and a blue channel command as eight-bit data (i.e., a data byte) representing a value from 0 to 255. The maximum value of 255 for any one of the color channels instructs the processor to control the corresponding light source(s) to operate at maximum available power (i.e., 100%) for the channel, thereby generating the maximum available radiant power for that color (such a command structure for an R-G-B lighting unit commonly is referred to as 24-bit color control). Hence, a command of the format [R, G, B]=[255, 255, 255] would cause the lighting unit to generate maximum radiant power for each of red, green and blue light (thereby creating white light).

It should be appreciated, however, that lighting units suitable for purposes of the present disclosure are not limited to a DMX command format, as lighting units according to various embodiments may be configured to be responsive to other types of communication protocols/lighting command formats so as to control their respective light sources. In general, the processor 102 may be configured to respond to lighting commands in a variety of formats that express prescribed operating powers for each different channel of a multi-channel lighting unit according to some scale representing zero to maximum available operating power for each channel.

The lighting unit 400 may include and/or be coupled to one or more power sources 408. In various aspects, examples of power source(s) include, but are not limited to, AC power sources, DC power sources, batteries, solar-based power sources, thermoelectric or mechanical-based power sources and the like. Additionally, in one aspect, the power source(s) may include or be associated with one or more power conversion devices that convert power received by an external power source to a form suitable for operation of the lighting unit, for example, as described in U.S. Patent Application Publication No. 20050213353, incorporated herein by reference.

The lighting unit 400 may be implemented in any one of several different structural configurations according to various embodiments of the present disclosure. Examples of such configurations include, but are not limited to, an essentially linear or curvilinear configuration, a circular configuration, an oval configuration, a rectangular configuration, combinations of the foregoing, various other geometrically shaped configurations, various two or three dimensional configurations, and the like. A given lighting unit also may have any one of a variety of mounting arrangements for the light source(s), enclosure/housing arrangements and shapes to partially or fully enclose the light sources, and/or electrical and mechanical connection configurations. In particular, in some implementations, a lighting unit may be configured as a replacement or "retrofit" to engage electrically and mechanically in a conventional socket or fixture arrangement (e.g., an Edison-type screw socket, a halogen fixture arrangement, a fluorescent fixture arrangement, etc.). Additionally, one or more optical elements as discussed above may be partially or fully integrated with an enclosure/housing arrangement for the lighting unit. Furthermore, the various components of the lighting unit discussed above (e.g., processor, memory, power, user interface, etc.), as well as other components that may be associated with the lighting unit in different implementations (e.g., sensors/transducers, other components to facilitate communication to and from the unit, etc.) may be packaged in a variety of ways; for example, in one aspect, any subset or all of the various lighting unit components, as well as other components that may be associated with the lighting unit, may be packaged together. In another aspect, packaged subsets of components may be coupled together electrically and/or mechanically in a variety of manners.

Figure 5:
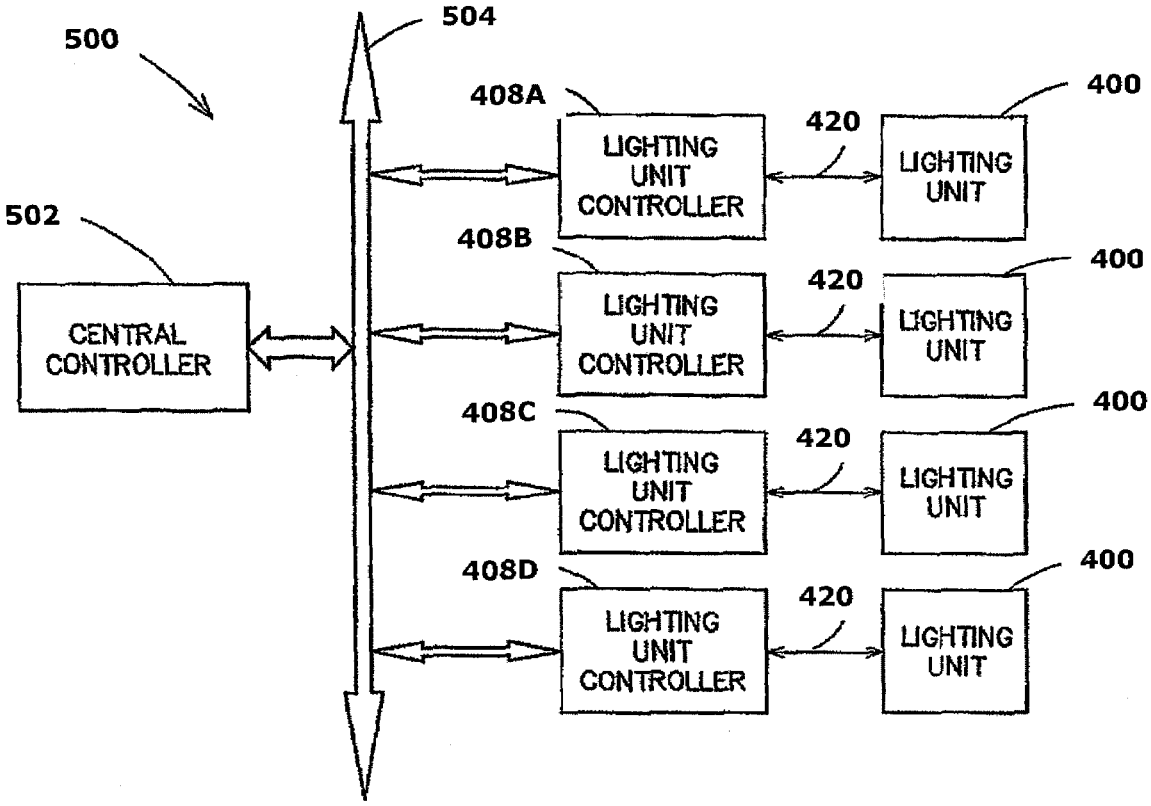
FIG. 5 is a diagram illustrating a networked lighting system according to some embodiments of the invention.

FIG. 5 illustrates an example of a lighting system 500 according to some embodiments of the present invention, wherein a number of lighting units 400, discussed above in connection with FIG. 4, are coupled together to form a networked lighting system. It should be appreciated, however, that the particular configuration and arrangement of lighting units shown in FIG. 5 is for purposes of illustration only, and that the invention is not limited to the particular system topology shown therein. Based on the networking concepts discussed herein, one or more architectural spaces may be outfitted with multiple gaps in surfaces and multiple light cove apparatus that may be controlled in a networked fashion.

Additionally, while not shown explicitly in FIG. 5, it should be appreciated that the networked lighting system 500 may be configured flexibly to include one or more user interfaces, as well as one or more signal sources such as sensors/transducers. For example, one or more user interfaces and/or one or more signal sources such as sensors/transducers (as discussed above in connection with FIG. 4) may be associated with any one or more of the lighting units of the networked lighting system. Alternatively (or in addition to the foregoing), one or more user interfaces and/or one or more signal sources may be implemented as "stand alone" components in the networked lighting system. Whether stand alone components or particularly associated with one or more lighting units, these devices may be "shared" by the lighting units of the networked lighting system. Stated differently, one or more user interfaces and/or one or more signal sources such as sensors/transducers may constitute "shared resources" in the networked lighting system that may be used in connection with controlling any one or more of the lighting units of the system.

Referring to FIG. 5, the lighting system 500 may include one or more lighting unit controllers (hereinafter "LUCs") 508A, 508B, 508C, and 508D, wherein each LUC is responsible for communicating with and generally controlling one or more lighting units 100 coupled to it. Although FIG. 5 illustrates one lighting unit 400 coupled to each LUC, it should be appreciated that the disclosure is not limited in this respect, as different numbers of lighting units may be coupled to a given LUC in a variety of different configurations (serially connections, parallel connections, combinations of serial and parallel connections, etc.) using a variety of different communication media and protocols.

Each LUC in turn may be coupled to a central controller 502 that is configured to communicate with one or more LUCs. Although FIG. 5 shows four LUCs coupled to the central controller via a generic connection 504 (which may include any number of a variety of conventional coupling, switching and/or networking devices), it should be appreciated that according to various embodiments, different numbers of LUCs may be coupled to the central controller. Additionally, according to various embodiments of the present disclosure, the LUCs and the central controller may be coupled together in a variety of configurations using a variety of different communication media and protocols to form the networked lighting system. Moreover, it should be appreciated that the interconnection of LUCs and the central controller, and the interconnection of lighting units to respective LUCs, may be accomplished in different manners (e.g., using different configurations, communication media, and protocols).

For example, according to one embodiment of the present invention, the central controller 502 shown in FIG. 5 may by configured to implement Ethernet-based communications with the LUCs, and in turn the LUCs may be configured to implement DMX-based communications with the lighting units 400. In particular, in one aspect of this embodiment, each LUC may be configured as an addressable Ethernet-based controller and accordingly may be identifiable to the central controller 502 via a particular unique address (or a unique group of addresses) using an Ethernet-based protocol. In this manner, the central controller may be configured to support Ethernet communications throughout the network of coupled LUCs, and each LUC may respond to those communications intended for it. In turn, each LUC may communicate lighting control information to one or more lighting units coupled to it, for example, via a DMX protocol, based on the Ethernet communications with the central controller.

More specifically, in some versions of this embodiment, the LUCs 508A, 508B, and 508C shown in FIG. 5 may be configured to be "intelligent" in that the central controller 502 may be configured to communicate higher level commands to the LUCs that need to be interpreted by the LUCs before lighting control information can be forwarded to the lighting units 100. For example, a lighting system operator may want to generate a color changing effect that varies colors from lighting unit to lighting unit in such a way as to generate the appearance of a propagating rainbow of colors ("rainbow chase"), given a particular placement of lighting units with respect to one another. In this example, the operator may provide a simple instruction to the central controller to accomplish this, and in turn the central controller may communicate to one or more LUCs using an Ethernet-based protocol high level command to generate a "rainbow chase." The command may contain timing, intensity, hue, saturation or other relevant information, for example. When a given LUC receives such a command, it may then interpret the command and communicate further commands to one or more lighting units using a DMX protocol, in response to which the respective sources of the lighting units are controlled via any of a variety of signaling techniques (e.g., PWM). It should again be appreciated that the foregoing example of using multiple different communication implementations (e.g., Ethernet/DMX) in a lighting system according to one embodiment of the present disclosure is for purposes of illustration only, and that the disclosure is not limited to this particular example.

From the foregoing, it may be appreciated that one or more lighting units as discussed above are capable of generating highly controllable variable color light over a wide range of colors, as well as variable color temperature white light over a wide range of color temperatures. Thus, one or more light cove apparatus according to the present invention, comprising one or more lighting units as discussed above, may provide a wide variety of intriguing lighting effects in architectural spaces.

Having thus described several illustrative embodiments, it is to be appreciated that various alterations, modifications, and improvements will readily occur to those skilled in the art. Such alterations, modifications, and improvements are intended to be part of this disclosure, and are intended to be within the spirit and scope of the claimed invention. While some examples presented herein involve specific combinations of functions or structural elements, it should be understood that those functions and elements may be combined in other ways according to the present invention to accomplish the same or different objectives. In particular, acts, elements, and features discussed in connection with one embodiment are not intended to be excluded from similar or other roles in other embodiments. Accordingly, the foregoing description and attached drawings are by way of example only, and are not intended to be limiting.

The invention claimed is:

1. A cove lighting apparatus for an architectural surface, comprising:

a cove member configured to fit within a gap defined by the architectural surface and comprising an interior surface that is recessed from the architectural surface; and at least one LED-based light source associated with the cove member for irradiating at least a portion of the interior surface with visible light perceivable by a viewer via the gap defined in the architectural surface, wherein the cove lighting apparatus is configured such that the at least one LED-based light source is concealed from the viewer.

2. The apparatus of claim 1, wherein the cove member includes a channel portion, and wherein: the at least one LED-based light source is coupled to the channel portion and positioned so as to irradiate at least the portion of the interior surface of the cove member with the visible light.

3. The apparatus of claim 2, further comprising a blocking member for concealing the at least one light LED-based source from the viewer.

4. The apparatus of claim 1, wherein the at least a portion the interior surface of the cove member comprises an essentially white matte surface configured to reflect and diffuse light.

5. The apparatus of claim 4, wherein the at least one LED-based light source is positioned with respect to the cove member such that the visible light is perceivable as a light surface that is essentially flush with the architectural surface.

6. The apparatus of claim 1, wherein the color of the visible light includes at least one non-white color.

7. The apparatus of claim 1, wherein the visible light includes essentially white light.

8. The apparatus of claim 1, further including at least one controller coupled to the at least one light source and configured to control at least one of a color, a color temperature and an intensity of the visible light.

9. The apparatus of claim 8, further including at least one user interface coupled to the at least one controller and configured to facilitate control of the at least one of the color, the color temperature, and the intensity of the visible light.

10. The apparatus of claim 8, wherein the at least one LED-based light source comprises:

at least one first LED for generating first radiation having a first spectrum; and at least one second LED for generating second radiation having a second spectrum different from the first spectrum.

11. The apparatus of claim 10, wherein the at least one controller independently controls a first intensity of the first radiation and a second intensity of the second radiation so as to control at least one of the color, the color temperature and the intensity of the visible light.

12. The apparatus of claim 11, wherein the at least one first LED includes at least one first white LED.

13. The apparatus of claim 12, wherein the at least one second LED includes at least one second white LED.

14. The apparatus of claim 1, wherein the visible light is perceived by the viewer as substantially uniform filing the gap in the architectural surface.

15. A method for providing architectural illumination, comprising:

forming a gap in an architectural surface;

disposing a cove member in the gap defined by the architectural surface, the cove member comprising an interior surface that is recessed from the architectural surface;

generating visible light by at least one light LED-based source; and irradiating at least a portion of the interior surface with visible light such that the visible light is perceivable by a viewer via the gap as a light surface that is essentially flush with the architectural surface.

* * * * *